US005405263A

United States Patent [19]

Gerdes et al.

[11] Patent Number: 5,405,263

[45] Date of Patent: Apr. 11, 1995

[54] SEALED GAS BURNER ASSEMBLY

[75] Inventors: Michael D. Gerdes, Florence, S.C.; Walter J. Larkin, Cedar Rapids, Iowa; Richard T. Jahr, Florence, S.C.

[73] Assignee: Caloric Corporation, Florence, S.C.

[21] Appl. No.: 124,143

[22] Filed: Sep. 20, 1993

[51] Int. Cl.[6] ..... F23D 14/62; F24C 3/00

[52] U.S. Cl. ..... 431/354; 126/39 E; 126/39 K

[58] Field of Search ..... 431/354, 202, 326, 328, 431/329, 349, 355, 356; 126/39 E, 39 K, 39 H

[56] References Cited

U.S. PATENT DOCUMENTS

| | | | |
|---|---|---|---|
| 4,565,523 | 1/1986 | Berkeldu | 431/354 |
| 5,112,218 | 5/1992 | Sigler | 431/354 X |
| 5,139,417 | 8/1992 | Ghassemzadeh | 431/354 |
| 5,213,091 | 5/1993 | Beach | 431/354 X |
| 5,328,357 | 7/1994 | Riehl | 431/354 X |

*Primary Examiner*—Larry Jones
*Attorney, Agent, or Firm*—William R. Clark

[57] ABSTRACT

A sealed gas surface burner having a ring portion that sits on the main top around the periphery of the main top aperture through which the burner extends. The ring portion forms a substantially liquid tight seal with the main top, and has a raised shoulder to prevent liquid on the main top from running down through the burner aperture in the main top. A burner body is supported by the ring portion at spaced intervals to provide passageways from underneath the main top. A cap is supported by the burner body thereby forming a chamber which receives a mixture of gaseous fuel and primary combustion air. The mixture issues from ports in the side wall of the burner body where it is ignited to produce a cooking flame. Secondary combustion air is drawn from underneath the main top through the passageways in the burner to support combustion of the flame.

19 Claims, 3 Drawing Sheets

SEALED GAS BURNER ASSEMBLY

BACKGROUND OF THE INVENTION

The field of the invention generally relates to gas surface burners, and more particularly relates to gas burners that are sealed to the main top to prevent spills from running down through the burner aperture in the main top.

In the typical configuration, the main top of gas range has a plurality of apertures through which the surface burners extend upwardly. For example, the throat of each burner head as it extends through the aperture may have diameter of two inches, and the aperture may be four inches in diameter. With such arrangement, there is a one inch annular concentric opening around each burner throat, and secondary combustion air passes from underneath the main top through this opening. As contrasted with the primary combustion air that is aspirated into the venturi to mix with the fuel before combustion, secondary combustion air is drawn to the flame to support combustion. One drawback of the above described arrangement is the liquid on the main top can run down through a burner aperture thus requiring lifting up the main top to clean underneath. For example, liquid may be present on the main top as a result of a pot boiling over, an accidental spill, or during cleaning of the main top.

Sealed gas burners typically have a flange that is sealed to the upper side of the main top. This arrangement has the advantage of preventing liquid from running down through the burner aperture, and thereby eliminates the need to lift up the main top to clean underneath. However, the sealing of the burner to the periphery of the burner aperture in the main top also seals up the heretofore described path for secondary combustion air. Therefore, sealed gas burners have totally relied on secondary combustion air flowing across the main top through the grates. It has been determined that with this arrangement, there may not be sufficient secondary combustion air to produce favorable flame characteristics, especially when a large pan is placed on the grate. That is, the space between main top and the pan has to be used not only for introducing secondary combustion air, but also for exhausting products of combustion. One prior art approach to providing good flame characteristics is to use taller grates thereby increasing the space between the main top and a pan. However, this approach raises safety concerns in that it may be easier for a pan to tip over. Another approach has been to increase the primary combustion air. However, this approach generally increases the velocity of the fuel/air mixture, and the flame may start to lift off or reach.

SUMMARY OF THE INVENTION

In accordance with the invention, a sealed gas burner adapted for extending up through an aperture in a main top comprises a burner body and a cap forming a chamber with a plurality of ports. Means are provided for receiving a mixture of fuel and primary combustion air into the chamber wherein the fuel and primary air mixture issues through the ports for ignition to produce a cooking flame. Means are provided for sealing the burner to the main top to prevent liquid spills on the main top from running down through the aperture. Also, the burner comprises means for providing a passageway for secondary combustion air to flow to the flame from underneath the main top up through the burner.

The sealing means may comprise a ring portion seated on the main top peripherally around the aperture. The ring portion may comprise an upwardly extending shoulder to provide a dam to prevent liquid on the main top from running down through the aperture. In one embodiment, the passageway providing means comprises a plurality of posts spaced at intervals around the ring portion to support the burner body and form the secondary combustion air passageways between the posts. Preferably, the burner body has a peripheral region that extends above and laterally beyond the shoulder of the ring portion to prevent falling liquid from directly entering the secondary air passageways. The cap may also extend laterally beyond the peripheral region of the burner body. Further, the ring portion may have at least one downwardly extending stud received in a corresponding locator hole in the main top.

The invention may also be practiced by a method of fabricating a gas surface cooking appliance comprising the steps of mounting a bracket in a burner box and connecting a venturi assembly having an outlet to the bracket. A main top having an aperture is then positioned over the burner box with the aperture aligned with the venturi outlet. An annular seal ring is seated on the main top around the periphery of the aperture, and a burner body is seated on a plurality of upwardly extending bosses of the annular ring wherein passageways are formed from underneath the main top between the bosses. Screws are driven down through the burner body into the bracket with the annular seal ring being sandwiched between the burner body and the main top to from a substantially liquid tight seal between the annular ring and the main top. A cap is then positioned on the burner body.

With such arrangement and method, the burner is sealed to the main top to prevent spills from running down through the aperture in the main top through which the burner extends. The passageways up through the burner provide, from underneath the main top, a supply of secondary combustion air that is independent of the size of a cooking utensil that is placed on the grate. Therefore, even when a large diameter pot is used, the secondary combustion air from underneath the main top assures favorable flame characteristics. That is, there is good flame stability without excessive lift-off or reaching.

BRIEF DESCRIPTION OF THE DRAWINGS

The foregoing objects and advantages will be more fully understood by reading the following Description of the Preferred Embodiment with reference to the drawings wherein.

DESCRIPTION OF THE PREFERRED EMBODIMENT

Figure 1:
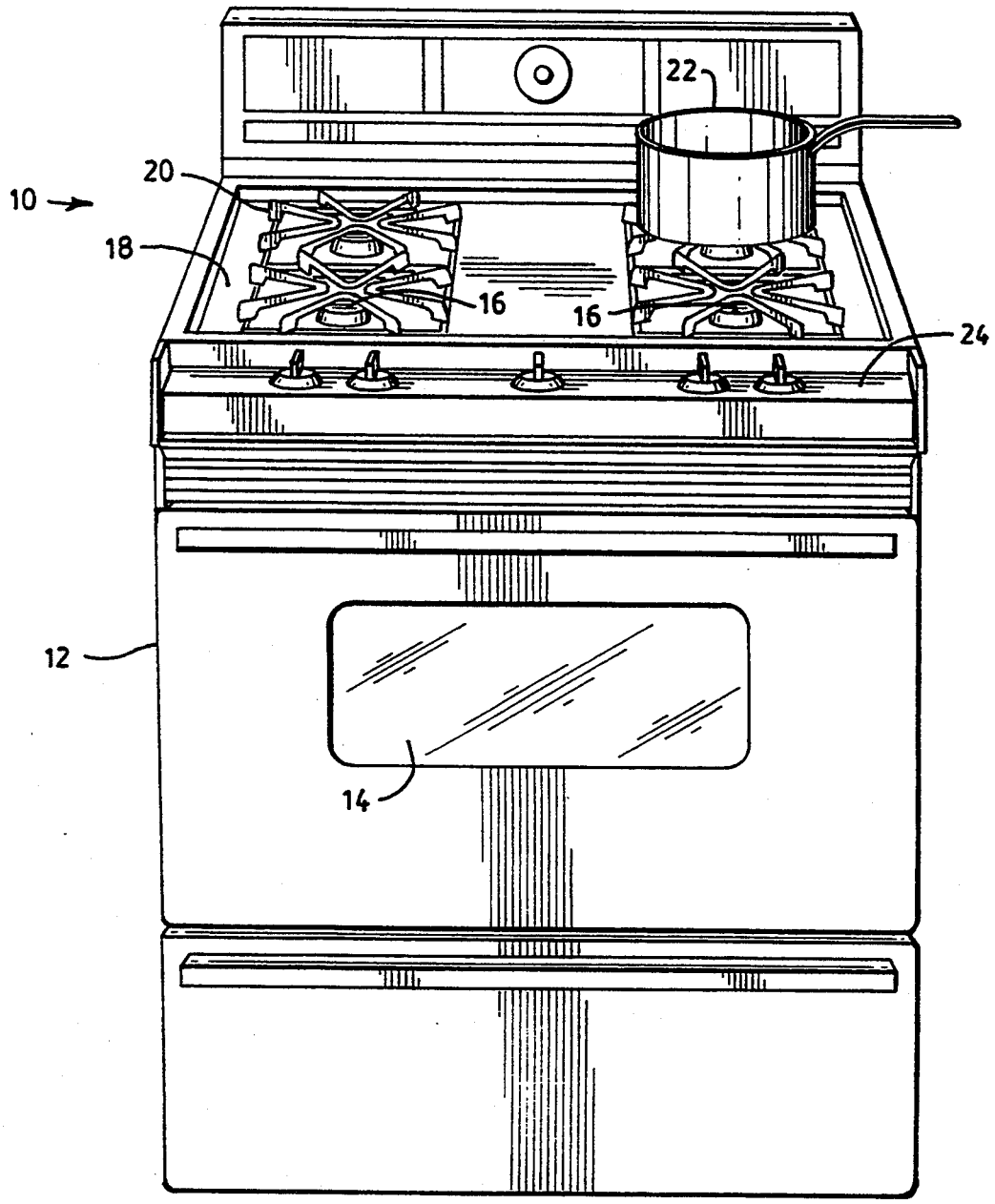
FIG. 1 is a front view of a gas range.

Referring to FIG. 1, a free standing gas cooking appliance 10 or range includes a cabinet 12 in which an oven 14 is housed. Also, four surface gas burners 16 are mounted to extend through and above main top 18. Grates 20 are seated on main top 18 to support cooking utensils 22 above surface burners 16. Control panel 24 is used to control oven 14 and surface burners 16.

Figure 2:
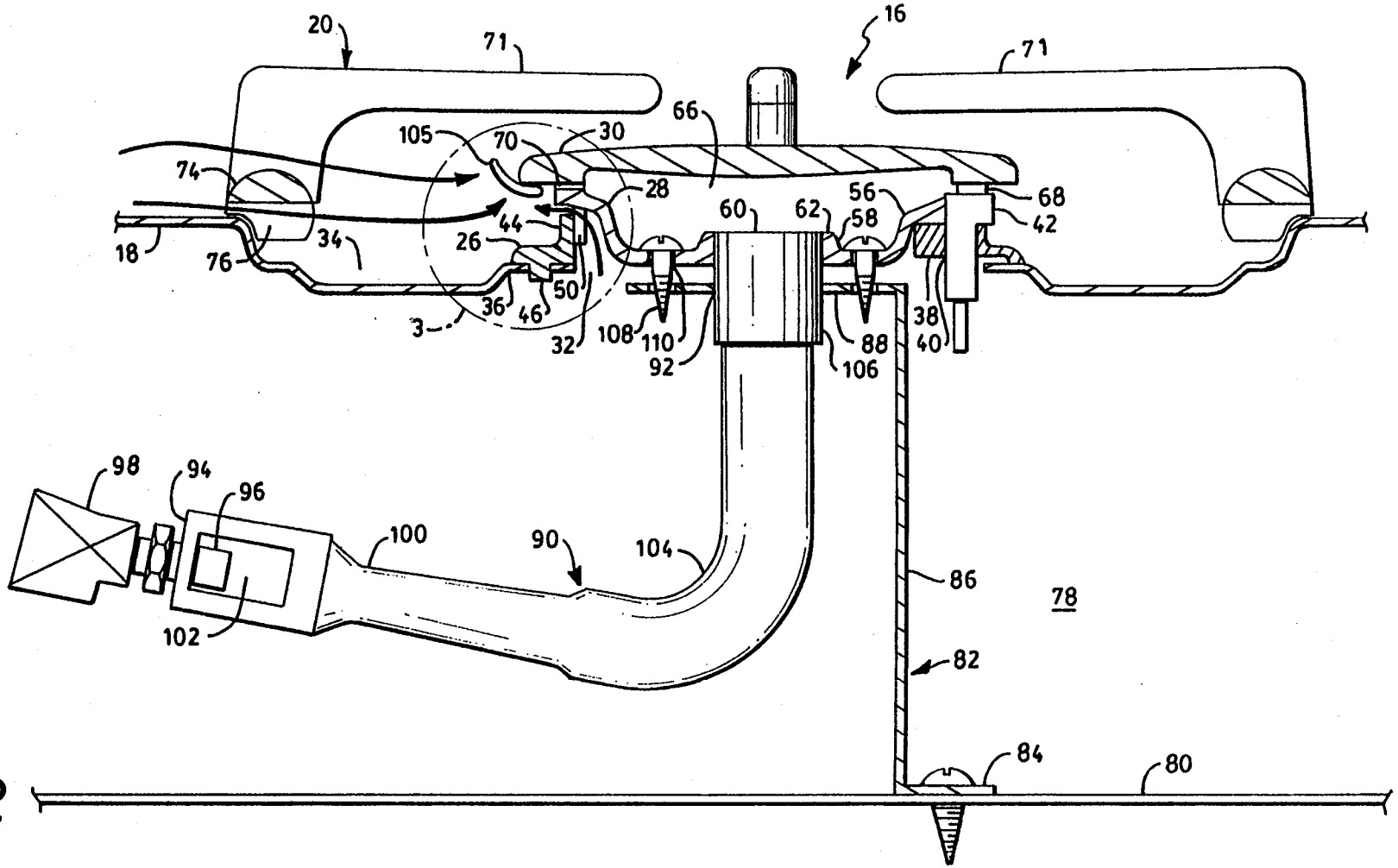
FIG. 2 is a side sectioned view of one of the gas surface burners of FIG. 1.

Referring to FIG. 2, a cross sectional view of a surface burner 16 shows an assembly including a rim or ring portion 26, a burner body 28, and a cap 30. Ring portion 26 has a flat underside ring that sits on main top 18 and surrounds aperture 32 through which burner 16 extends through main top 18. In particular, main top 18 here is a substantially flat metal panel that has a depression 34 or valley region that surrounds each burner 16 and rises up to an annular ridge 36. As shown, ridge 36 is flat-topped, and supports ring portion 26. At one angular orientation, ring portion 26 has a block 38 with a vertical opening 40 through which conventional electrical igniter 42 passes.

Figure 3:
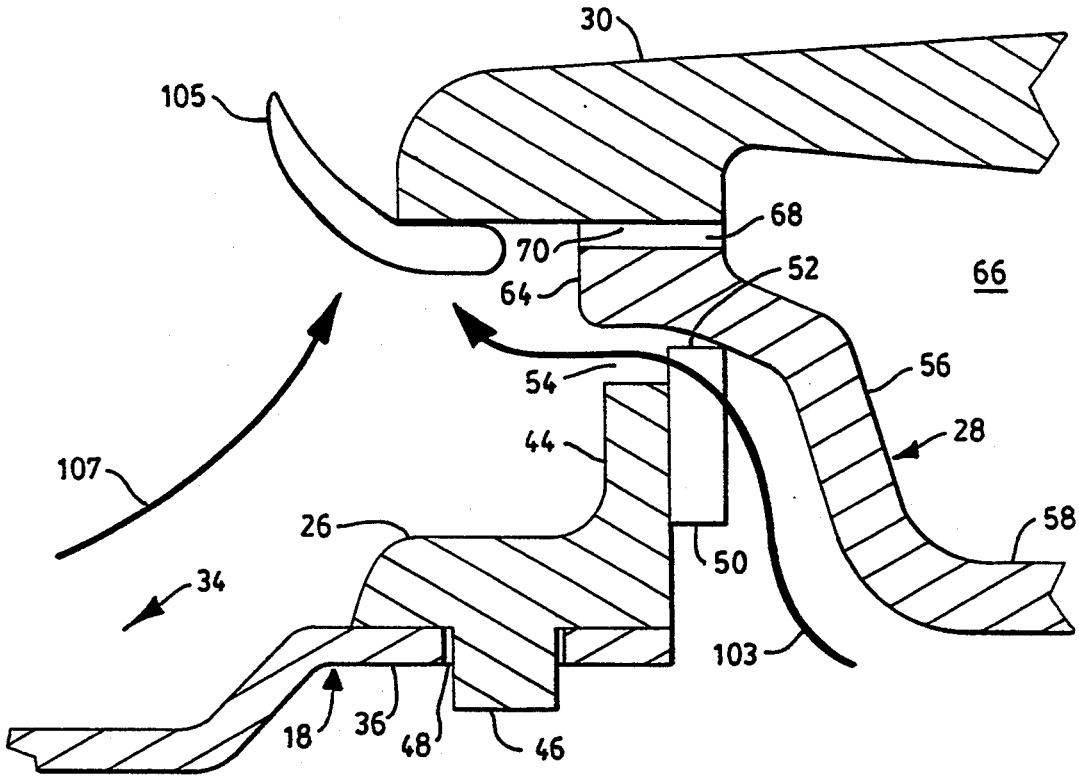
FIG. 3 is an expanded view of the region within line 3—3 of FIG. 2.

Still referring to FIG. 2, and also to FIG. 3 which shows an expanded view of region 3—3 of FIG. 2, ring portion 26 has a shoulder 44 or raised lip which functions as a dam in a manner to be described. Ring portion 26 also has a plurality of downwardly extending studs 46 that are received in corresponding locator holes 48 in ridge 36 of main top 18. Here, two posts 50 extend upwardly from the inner surface of shoulder 44 at spaced angular locations. The tops 52 of posts 50 along with the upper surface of block 38 are three points that define a substantially horizontal plane and support burner body 28 without rocking or tipping. Although one post 50 and block 38 are both shown in the same view in FIG. 2, two posts 50 and block 38 would generally be spaced by approximately 120 degrees to provide optimum support for burner body 28. In between posts 50 and block 38 are voids that form passageways 54 from the underside of main top 18 up through aperture 32 and between ring portion 26 and burner body 28. As will be described in detail later herein, passageways 54 are used to provide a supply of secondary combustion air to burners 16 from underneath main top 18.

Burner body 28 is a cast metal part that has a side wall 56 and a bottom wall 58 with a central opening 60 surrounded by a flange 62. As shown, side wall 56 slopes outwardly and has a peripheral region 64 that extends above and laterally beyond shoulder 44 that defines the exit of passageways 54. The underside of side wall 56 rests on two posts 50 and block 38. Because there are three points of support rather than more, burner body 28 is prevented from rocking or tipping. Burner body 28 is generally bowl-shaped and has an open top which is covered by removable cap 30 to form a burner head chamber 66. As is conventional, cap 30 is keyed to burner body 28 to maintain alignment of cap 30. Here, the top of side wall 56 has slots 68 or is serrated to form gas issuing ports 70; alternatively, ports 70 could be formed by serrating the undersurface of cap 30. As shown, cap 30 extends out beyond the peripheral region 64 of burner body 28 and ports 70.

Referring still to FIG. 2, grate 20 is contoured to nest on the outer edge of depression 34 to fix the location of grate 20 on main top 18 around burner 16. The horizontal utensil supporting members 71 of grate 20 are interconnected by an annular connector member 74 that is elevated or spaced from main top 18 by a plurality of spaced bosses 76. Accordingly, a portion of secondary combustion air can flow across main top 18 and down into depression 34 without being deflected up and over grate connector member 74.

Main top 18 covers a burner box region 78 having a floor 80 which may function as the insulation retainer. Floor 80 is rigidly attached to the cabinet 12 or the frame of range 10. A bracket 82 has a foot 84 securely attached to floor 80, and a vertical leg 86 that connects to a horizontal plate 88. Venturi/mixer tube 90 passes through an aperture 92 in horizontal plate and is mounted thereto. In particular, conventional venturi/-mixer tube 90 includes open end 94 suitably aligned with a control hood 96 to receive a flow of gaseous fuel when valve 98 is open. The flow of gas into venturi 100 causes primary combustion air to be aspirated in through primary air shutter opening 102. The mixture of gaseous fuel and primary combustion air is conveyed through mixer tube 104 and is received in chamber 66 from where it issues through ports 70. After initial ignition by electrical igniter 42, the flame 105 burns around burner body 28, and continues to burn thereafter so long as valve 98 remains open.

Referring specifically to FIG. 3, passageways 54 between posts 50 and block 38 provide paths for secondary combustion air 103 to be drawn to the flame 105 from underneath the main top 18. It is important to note that the flow of secondary combustion air 103 through passageways 54 is independent of the size of a cooking utensil 22 that is placed on grate 20. Therefore, favorable flame characteristics are provided even when a large diameter pot or pan is used. As shown, connector member 74 of grate 20 is elevated from main top 18 so secondary combustion air 107 or tertiary air can also be drawn directly across main top 18 and down into depressions 34 without being diverted above a portion of grate 20.

In fabrication, the horizontal plate 88 of bracket 82 is connected to a flange 106 of venturi/mixer tube 90, and the foot 84 of bracket 82 is secured to the burner box floor 80 or insulation retainer. As is conventional, the open end 94 of venturi/mixer tube 90 is suitably aligned to receive gaseous fuel from control hood 96. Next, the main top 18 is seated down over the burner box 78, and a ring portion 26 is seated peripherally around each burner aperture 32. Locator holes 48 which receive corresponding studs 46 are provided in the peripheral region around each aperture 32 to enable quick and continuous alignment of each ring portion 26. Also, the studs 46 prevent rotation of burners 16 during operation. Optionally, a sealing gasket may be placed between the ring or rim portion 26 to provide a better seal. The ring portion 26 has significant thermal isolation from burner body 28 because these respective parts only contact at posts 50 and block 38, so there is very little thermal conduction from the relatively hot burner body 28. However, an optional gasket or O-ring must still be fabricated from a relatively high temperature material.

Screws 108 are then driven through corresponding holes 110 in the bottom wall 58 of burner body 28 and into horizontal plate 88 of bracket 82. In such manner, burner body 28 is drawn downwardly thereby sandwiching ring portion 26 between burner body 28 and main top 18. By such arrangement, a substantially liquid-tight seal is formed between ring portion 26 and main top 18, and if a gasket were used, the seal could be made even more liquid-tight. Screws 108 may further function to draw burner body 28 tightly against a ridge on flange 106 and block 38. In such manner, respective seals are formed to prevent gas from leaking out of chamber 66 around flange 106 and out around block 38. Screws 108 also serve to hold down the main top 18. For example, if four surface burners 16 are used and each burner 16 has two screws 108, the main top will be held down by eight screws 108 anchored into four respective brackets 82 mounted to insulation retainer or burner box floor 80. Cap 30 is conventionally keyed to be removably seated on burner body 28. The fabrication process is then completed by placing grate 20 around burner 16.

In operation, burner 16 is substantially sealed to main top 18, so there is essentially no reason to have to reverse the heretofore described fabrication steps to gain access underneath the main top 18 such as for cleaning. That is, any liquid on the main top 18 such as by boiling over, spills or cleaning, remains on the main top 18 for clean-up without running down through burner aperture 32. Typically, the liquid collects in depression 34 and is retained there by the dam formed by the combined height of ridge 36 and shoulder 44. Therefore, the liquid can be cleaned up using a sponge or the like. Further, the peripheral region 64 of burner body 28 extends above and laterally beyond the entrance to passageways 54 so falling liquid does not directly enter passageways 54. As is conventional, cap 30 extends laterally beyond burner body 28 so that falling liquid does not directly enter ports 70, or passageways 54. Therefore, in the heretofore described manner, burner 16 has the advantages of other sealed burners in that liquid is prevented from running down below the main top 18 thereby complicating clean-up. Further, burner 16 provides a flow of secondary combustion air from underneath the main top 18 so that the supply of secondary combustion air 103 is substantially independent of the size of the cooking utensil 22 that is used. That is, favorable flame characteristics are attained even when a large diameter cooking utensil 22 is placed on a grate 20.

The outlets of secondary combustion air passageways 54 are close below the base of ports 70 to enhance flame stability thereby reducing lift off or reaching of flame 105. Another advantage of the present arrangement is that the flow of air up through passageways 54 may keep the burner box region 78 and control components of control panel 24 cooler.

This concludes the Description of the Preferred Embodiment. A reading of it by those skilled in the art will bring to mind many alterations and modifications that do not fall outside the spirit and scope of the invention. Therefore, it is intended that the scope of the invention be limited only by the appended claims.

What is claimed is:

1. A sealed gas burner adapted for extending up through an aperture in a main top, said burner comprising:

a burner body and a cap forming a chamber with a plurality of ports;

means for receiving a mixture of fuel and primary combustion air into said chamber, said fuel and air mixture issuing through said ports for ignition to produce a cooking flame;

means for sealing said burner to the main top to prevent liquid on the main top from running down through the aperture; and means for providing a passageway for secondary combustion air to flow to said flame from underneath said main top up through said burner.

2. The sealed gas burner recited in claim 1 wherein said sealing means comprises a ring portion seated on said main top peripherally around said aperture.

3. The sealed gas burner recited in claim 2 wherein said ring portion comprises an upwardly extending shoulder to provide a dam to prevent liquid on said main top from running down through said aperture.

4. The sealed gas burner recited in claim 3 wherein said passageway providing means comprises a plurality of posts spaced at intervals around said ring portion to support said burner body and form said secondary air passageways between said posts.

5. The sealed gas burner recited in claim 4 wherein said burner body has a peripheral region extending above and laterally beyond said shoulder of said ring portion to prevent falling liquid from entering said secondary air passageways.

6. The sealed gas burner recited in claim 5 wherein said cap extends laterally beyond said peripheral region of said burner body.

7. The sealed gas burner recited in claim 2 wherein said ring portion has at least one downwardly extending stud received in a corresponding locator hole in said main top.

8. A sealed gas burner adapted for extending up through an aperture in a main top, said burner comprising:

a ring portion seated on the main top peripherally around the aperture and forming a substantially liquid tight seal with the main top, said ring portion having a raised lip to provide an annular dam around the aperture to prevent liquid on the main top from running down through the aperture;

a burner body having a sidewall with an open top, said burner body being supported by said ring portion at spaced locations to provide therebetween passageways from underneath the main top up between said ring portion and said burner body; and a cap seated on said burner body to form with said burner body a chamber having a plurality of ports, said chamber being adapted for receiving a mixture of fuel and primary combustion air which issues through said ports and ignites to provide a cooking flame wherein at least a portion of secondary combustion air for said flame is supplied from underneath the main top through said passageways between said ring portion and said burner body.

9. The sealed gas burner recited in claim 8 wherein said ring portion has a plurality of annularly spaced upwardly extending posts to support said burner body and provide said secondary combustion air passageways from underneath the main top.

10. The sealed gas burner recited in claim 8 wherein said burner body has a peripheral region extending above and laterally beyond said lip of said ring portion to prevent falling liquid from entering said secondary combustion air passageways.

11. The sealed gas burner recited in claim 10 wherein said cap extends laterally beyond said peripheral region of the burner body.

12. The sealed gas burner recited in claim 8 wherein said ring portion has at least one downwardly extending stud adapted for being received in a corresponding locator hole of the main top.

13. The sealed gas burner recited in claim 8 further comprising an electrical igniter extending up through a corresponding opening in said ring portion.

14. A gas surface cooking appliance comprising:

a main top having at least one surface burner aperture;

a sealed gas surface burner extending up through said aperture of said main top, said burner comprising an annular seal member seated on said main top peripherally around said aperture and forming a substantially liquid tight seal with said main top, said annular seal member having a raised shoulder forming an annular dam to prevent liquid on said main top from running down through said aperture in said main top;

said burner further comprising a burner body and cap forming a chamber with ports, said burner body being supported by said annular seal member at spaced locations around said seal member to form passageways from underneath said main top between said spaced locations;

means for supplying a mixture of fuel and primary combustion air to said chamber, said mixture issuing from said ports; and means for igniting said mixture issuing from said ports to produce a cooking flame that receives secondary combustion air through said passageways from underneath said main top.

15. The gas surface cooking appliance recited in claim 14 wherein said burner body is supported by a plurality of posts extending upwardly from said annular seal member at said spaced locations, said passageways being formed by voids between said posts.

16. The gas surface cooking appliance recited in claim 14 wherein said seal member comprises a downwardly extending stud received in a corresponding locator hole in said main top.

17. The gas surface cooking appliance recited in claim 14 wherein said burner body comprises a peripheral region extending above and laterally beyond said raised shoulder of said seal member to prevent falling liquid from entering said secondary combustion air passageways.

18. The gas surface cooking appliance recited in claim 14 further comprising a support bracket extending under said burner body, said burner body being screwed down to said bracket to secure said burner body to said cooking appliance with said seal member sandwiched between said burner body and said main top.

19. A method of fabricating a gas surface cooking appliance comprising the steps of:

connecting a venturi assembly having an outlet to a bracket;

mounting said bracket in a burner box;

positioning a main top having an aperture aligned with said venturi outlet over said burner box;

seating an annular seal ring on said main top around the periphery of said aperture;

seating a burner body of a burner on a plurality of upwardly extending bosses of said annular ring wherein passageways from underneath said main top are formed through said aperture and up between said bosses;

driving screws down through said burner body and into said bracket wherein said annual seal ring is sandwiched between said burner body and said main top to form a substantially liquid tight seal between said annular ring and said main top; and positioning a cap on said burner body.

* * * * *